US011151972B2

(12) United States Patent
Zheng

(10) Patent No.: US 11,151,972 B2
(45) Date of Patent: Oct. 19, 2021

(54) ACOUSTIC COMPONENT, ACOUSTIC APPARATUS AND ACOUSTIC SYSTEM

(71) Applicant: Harman International Industries, Incorporated, Stamford, CT (US)

(72) Inventor: James Zheng, Shenzhen (CN)

(73) Assignee: Harman International Industries, Incorporated, Stamford, CT (US)

( * ) Notice: Subject to any disclaimer, the term of this patent is extended or adjusted under 35 U.S.C. 154(b) by 367 days.

(21) Appl. No.: 16/341,914

(22) PCT Filed: Oct. 21, 2016

(86) PCT No.: PCT/CN2016/102843
§ 371 (c)(1),
(2) Date: Apr. 14, 2019

(87) PCT Pub. No.: WO2018/072198
PCT Pub. Date: Apr. 26, 2018

(65) Prior Publication Data

US 2019/0244595 A1 Aug. 8, 2019

(51) Int. Cl.

| | |
|---|---|
| ***G10K 11/22*** | (2006.01) |
| ***G10K 11/02*** | (2006.01) |
| ***G10K 11/08*** | (2006.01) |
| ***H04R 1/30*** | (2006.01) |
| ***H04R 1/34*** | (2006.01) |

(52) U.S. Cl.
CPC ..... *G10K 11/08* (2013.01); *G10K 11/22* (2013.01)

(58) Field of Classification Search
CPC ..... G10K 11/02; G10K 11/08; G10K 11/22; G10K 11/025; H04R 1/30; H04R 1/34; H04R 1/345
See application file for complete search history.

(56) References Cited

U.S. PATENT DOCUMENTS 1,685,086 A * 9/1928 Miller ..... G10K 9/13 381/340
2,135,610 A * 11/1938 Wente ..... H04R 1/345 181/187
2,789,651 A * 4/1957 Daniels ..... H04R 1/342 381/338

(Continued)

FOREIGN PATENT DOCUMENTS

CN 2463908 Y 12/2001
CN 201465535 U 5/2010

(Continued)

OTHER PUBLICATIONS

EP 16919415.6 EPO Search Report.

*Primary Examiner* — Edgardo San Martin
(74) *Attorney, Agent, or Firm* — Angela M. Brunetti

(57) ABSTRACT

An acoustic component, an acoustic apparatus and an acoustic system are provided. The acoustic component has a pipe, a slot configured on the pipe that has an elongation direction along an elongation direction of the pipe, and a horn extending from a first end of the pipe. The acoustic apparatus includes the acoustic component and further includes an acoustic driver acoustically coupled with a second end of the pipe to radiate acoustic energy carried in waves into the pipe. The acoustic energy carried in waves is radiated to the environment through the slot and the horn.

15 Claims, 6 Drawing Sheets

(56) References Cited

U.S. PATENT DOCUMENTS

| | | | | | |
|---|---|---|---|---|---|
| 2,939,922 | A | | 6/1960 | Rudolf | |
| 3,944,757 | A | | 3/1976 | Tsukamoto | |
| 4,206,831 | A | * | 6/1980 | Welch | G10K 11/025 181/159 |
| 4,616,731 | A | * | 10/1986 | Robinson | H04R 1/2857 181/148 |
| 5,046,581 | A | * | 9/1991 | Mitchell | H04R 1/26 181/152 |
| 5,552,569 | A | * | 9/1996 | Sapkowski | H04R 1/2865 181/151 |
| 6,519,348 | B1 | * | 2/2003 | Ikeuchi | H04R 1/345 181/152 |
| 7,268,467 | B2 | * | 9/2007 | De Vries | H04R 1/345 181/150 |
| 7,747,033 | B2 | * | 6/2010 | Uchimura | H04R 1/342 381/356 |
| 7,751,582 | B2 | * | 7/2010 | Akino | H04R 1/342 381/337 |
| 8,351,630 | B2 | * | 1/2013 | Ickler | G10K 11/26 381/338 |
| 8,995,700 | B2 | * | 3/2015 | Bothe | H04R 1/345 381/340 |
| 9,635,454 | B2 | * | 4/2017 | Larrieu | H04R 1/2826 |
| 10,194,235 | B2 | * | 1/2019 | Li | H04R 1/2842 |
| 10,327,066 | B2 | * | 6/2019 | Jung | H04R 5/02 |
| 10,667,043 | B2 | * | 5/2020 | Kelly | H04R 1/025 |
| 10,812,897 | B1 | * | 10/2020 | Arango-Vargas | H04R 1/026 |
| 2011/0219936 | A1 | * | 9/2011 | Masuda | G10D 7/00 84/330 |
| 2012/0039475 | A1 | | 2/2012 | Berardi et al. | |
| 2012/0247866 | A1 | | 10/2012 | Lage | |

FOREIGN PATENT DOCUMENTS

| | | | | | |
|---|---|---|---|---|---|
| CN | 203849981 | U | | 9/2014 | |
| CN | 203682596 | U | | 10/2014 | |
| CN | 204087772 | U | | 1/2015 | |
| CN | 105645108 | A | | 8/2016 | |
| EP | 2604045 | A1 | | 6/2013 | |
| EP | 2604045 | B1 | | 7/2015 | |
| EP | 3439324 | A4 | * | 10/2019 | H04R 1/34 |
| JP | H05236585 | A | | 9/1993 | |

* cited by examiner

ACOUSTIC COMPONENT, ACOUSTIC APPARATUS AND ACOUSTIC SYSTEM

FIELD

The present disclosure generally relates to an acoustic component, an acoustic apparatus and an acoustic system.

BACKGROUND

Existing acoustic systems possess relatively good virtual surround sound effect at mid frequency range and low frequency range but unsatisfactory virtual surround sound effect at high frequency range. An acoustic system which can provide better surround sound effect at high frequency range is needed.

SUMMARY

In an embodiment, an acoustic component is provided, including: a pipe, wherein a slot is configured on the pipe with an elongation direction along an elongation direction of the pipe; and a horn extending from a first end of the pipe.

In some embodiments, a cross-sectional area of the pipe gradually reduces along the elongation direction of the pipe from a second end of the pipe to the first end of the pipe.

In some embodiments, projections of centers of at least two cross sections of the pipe to an end surface are located in different positions, wherein the end surface is the cross section at the second end of the pipe.

In some embodiments, width of the slot may be not greater than 2 millimeters.

In some embodiments, length of the slot may be less than length of the pipe.

In some embodiments, the length of the pipe, a cross-sectional area of the pipe at the first end and a cross-sectional area of the pipe at the second end are configured, on the condition that at least a portion of waves radiated into the pipe are reflected by an inner surface of the pipe to form reflected waves penetrating the slot, wherein the reflected waves forms an angle within a range from about 155° to about 175° relative to the slot.

In an embodiment, an acoustic apparatus is provided, including an acoustic component and an acoustic driver, wherein the acoustic component includes: a pipe, wherein a slot is configured on the pipe with an elongation direction along an elongation direction of the pipe; and a horn extending from a first end of the pipe, and the acoustic driver is acoustically coupled with a second end of the pipe to radiate acoustic energy carried in waves to a listening environment through the slot and the horn.

In some embodiments, a cross-sectional area of the pipe gradually reduces along the elongation direction of the pipe from a second end of the pipe to the first end of the pipe.

In some embodiments, projections of centers of at least two cross sections of the pipe to an end surface are located in different positions, wherein the end surface is the cross section at the second end of the pipe.

In some embodiments, width of the slot may be not greater than 2 millimeters.

In some embodiments, length of the slot may be less than length of the pipe.

In some embodiments, the length of the pipe, a cross-sectional area of the pipe at the first end and a cross-sectional area of the pipe at the second end are configured, on the condition that at least a portion of waves radiated into the pipe are reflected by an inner surface of the pipe to form reflected waves penetrating the slot, wherein the reflected waves forms an angle within a range from about 155° to about 175° relative to the slot.

In an embodiment, an acoustic system is provided, including at least one acoustic apparatus and at least one speaker, wherein each acoustic apparatus includes an acoustic component and an acoustic driver, wherein the acoustic component includes: a pipe, wherein a slot is configured on the pipe with an elongation direction along an elongation direction of the pipe; and a horn extending from a first end of the pipe, and wherein the acoustic driver is acoustically coupled with a second end of the pipe to radiate acoustic energy carried in waves to a listening environment through the slot and the horn.

In some embodiments, a cross-sectional area of the pipe gradually reduces along the elongation direction of the pipe from a second end of the pipe to the first end of the pipe.

In some embodiments, projections of centers of at least two cross sections of the pipe to an end surface are located in different positions, wherein the end surface is the cross section at the second end of the pipe.

In some embodiments, width of the slot may be not greater than 2 millimeters.

In some embodiments, length of the slot may be less than length of the pipe.

In some embodiments, the length of the pipe, a cross-sectional area of the pipe at the first end and a cross-sectional area of the pipe at the second end are configured, on the condition that at least a portion of waves radiated into the pipe are reflected by an inner surface of the pipe to form reflected waves penetrating the slot, wherein the reflected waves forms an angle within a range from about 155° to about 175° relative to the slot.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION OF EMBODIMENTS

Figure 1:
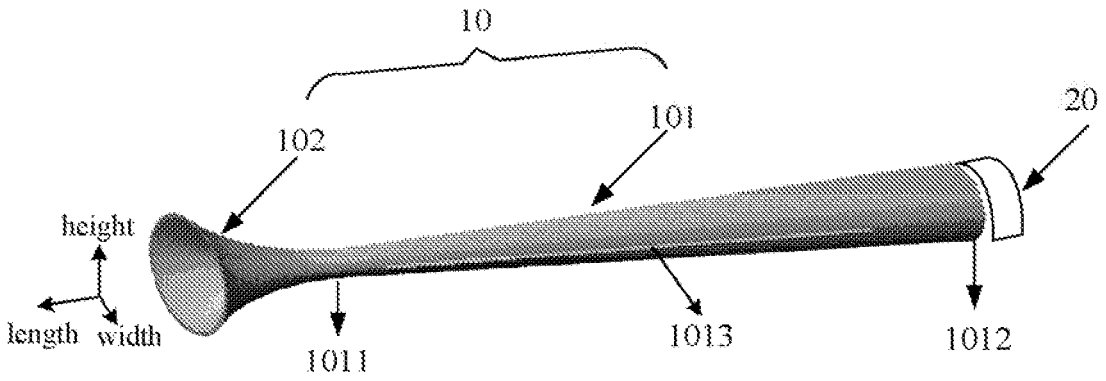
FIG. 1 is a schematic diagram illustrating an acoustic apparatus according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

FIG. 1 is a schematic diagram illustrating an acoustic apparatus according to an embodiment.

Referring to FIG. 1, the acoustic apparatus includes a directional acoustic component 10 and an acoustic driver 20 acoustically coupled with the directional acoustic component 10. In some embodiments, a directional acoustic component denotes to a speaker that radiates more acoustic energy in some directions than in others.

Referring to FIG. 1, the directional acoustic component 10 constitutes of a pipe 101 and a horn 102 extending from a first end 1011 of the pipe 101. A second end 1012 of the pipe 101 is coupled with the acoustic driver 20 to realize the acoustic connection between the directional acoustic component 10 and the acoustic driver 20. The acoustic driver 20 is configured to convert electric energy into mechanical energy. After being applied with a power supply and an audio signal, the acoustic driver 20 may produce acoustic energy which is carried in waves and radiated into the pipe 101 by the acoustic driver 20.

In some embodiments, a slot 1013 is configured on the pipe 101 with an elongation direction along an elongation direction of pipe 101, that is, the slot 1013 is configured along at least a portion of the length of the pipe 101. The acoustic energy is radiated to the environment through the slot 1013 and the horn 102. Compared with forming multiple holes along the length of the pipe 101, the slot 1013 may reduce reflection of waves inside the pipe 101, and further reduce standing waves which can cause an undesired radiation pattern in the pipe 101.

In some embodiments, width of the slot 1013 may be not greater than 2 millimeters. The selected width range may ensure sound waves to be propagated in the pipe 101 in plane waves. That is, with the selected width range, the propagation mode of the sound waves may not be affected.

In some embodiments, the length of the slot 1013 may be less than length of the pipe 101.

In some embodiments, the pipe 101 and the horn 102 may include plastic, such as Acrylonitrile Butadiene Styrene (ABS) plastic, Polyamid (PA) plastic or Polycarbonate (PC) plastic.

In some embodiments, an inner surface of the pipe 101 may be smooth.

Figure 2:
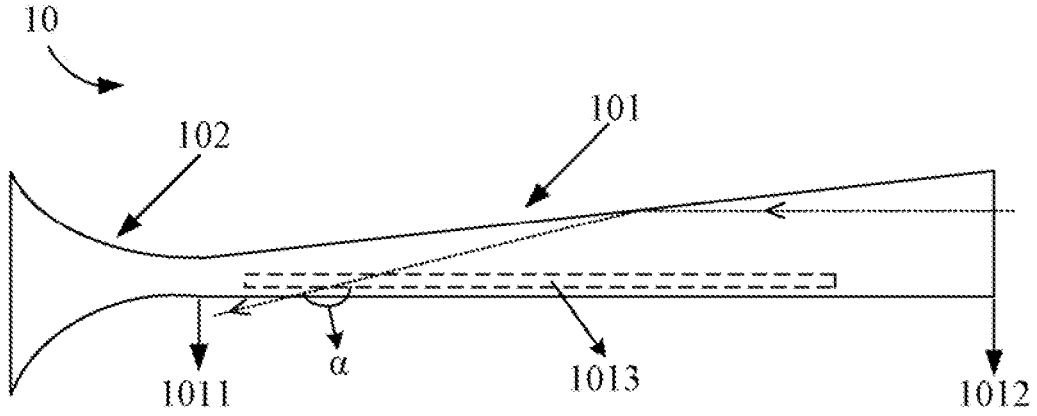
FIG. 2 is a sectional view of the directional acoustic component shown in FIG. 1.

FIG. 2 is a sectional view of the directional acoustic component 10 shown in FIG. 1.

Figure 3:
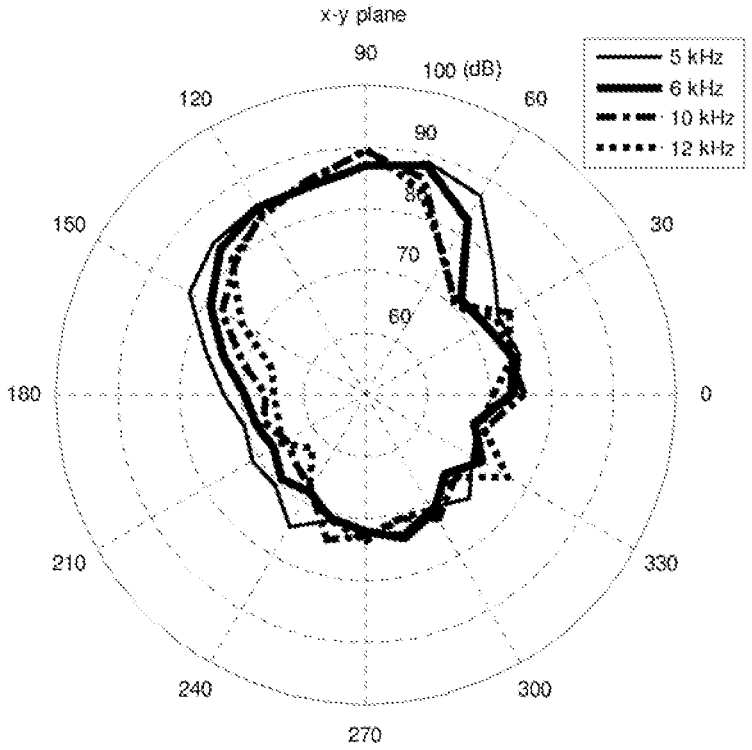
FIGS. 3 to 5 are exemplary radiation patterns of a directional acoustic component according to an embodiment.

Referring to FIGS. 2 and 3, in some embodiments, a cross-sectional area of the pipe 101 may vary along the length of the pipe 101. In some embodiments, the cross-sectional area of the pipe 101 may gradually reduce along the elongation direction of the pipe 101 from the second end 1012 of the pipe 101 to the first end 1011 of the pipe 101. In some embodiments, projections of centers of at least two cross sections of the pipe 101 to an end surface are located in different positions, wherein the end surface is the cross section of the pipe 101 at the second end of the pipe 101. In some embodiments, the cross sections of the pipe 101 may be circles, and projections of the circles to the end surface may not be concentric. This design may strengthen the acoustic energy at the slot 1013 and the horn 102.

In some embodiments, the length of the pipe 101, a cross-sectional area of the pipe 101 at the first end 1011 and a cross-sectional area of the pipe 101 at the second end 1012 are configured, on the condition that at least a portion of the waves (represented by a dotted line with an arrow in FIG. 2) radiated into the pipe 101 are reflected by the inner surface of the pipe 101 to form reflected waves penetrating the slot 1013, wherein the reflected waves forms an angle $\alpha$ within a range from about 155° to about 175° relative to the slot, i.e., an angle within a range from about 65° to about 85° relative to a reference position which is perpendicular to the slot 101 (hereinafter, this angle is called the relative angle).

In one embodiment, the length of the pipe 101 may be 20 centimeters, a diameter of the pipe 101 at the second end 1012 may be 4 centimeters, and a ratio of the cross-sectional area of the pipe 101 at the first end 1011 to the cross-sectional area of the pipe 101 at the second end 1012 may be within a range from 0.1 to 0.6.

It should be noted that, when the acoustic apparatus is in operation, the horn 102 faces an object, for example, a wall, and the slot 1013 faces an audience. By employing the above pipe 101 with the slot 1013, the audience can hear sounds from different directions, particularly, the audience may feel that the acoustic energy is relatively strong at the relative angle from about 65° to about 85°. That is, the directivity at about 65° to 85° is enhanced. The slot 1013 may be considered as a line source which forms different directivity patterns at different frequencies, and thus can create wide-spaced illusion.

If no horn is formed at the end of the pipe, sound waves may exist in a pipe having a relatively small cross-sectional area and radiated to free air having an infinite cross-sectional area. In this situation, impedance mismatch occurs, and many sound waves may not be radiated to free air, while a large portion of acoustic energy may be reflected into the pipe to form standing waves, which may affect the directivity of the radiation.

To reduce the reflective sound waves in the pipe, impedance inside the pipe should match that outside the pipe (i.e., in the free air). Cross-sectional areas of a horn vary gradually, which may ensure the impedance matching. With the horn 102, impedance inside the pipe 101 matches that outside the pipe 101, reflective sound waves may be greatly reduced, and thus standing waves are reduced.

Besides, the horn 102 may greatly enhance the directivity of sounds. As the horn 102 faces the wall in operation, acoustic energy at the relative angle of about 85° to about 90° may be increased based on the reflection by the wall. And the audience may feel that the sounds come from the direction of the wall. Thus, the directivity at the relative angle of about 85° to about 90° is enhanced.

In some embodiments, directivity performance of the directional acoustic component is indicated by a radiation pattern. Generally, the radiation pattern of the directional acoustic component is typically displayed as a polar plot or a set of polar plots at different frequencies. The directional characteristics may be described in terms of the direction of maximum radiation and the degree of directivity.

Figure 4:
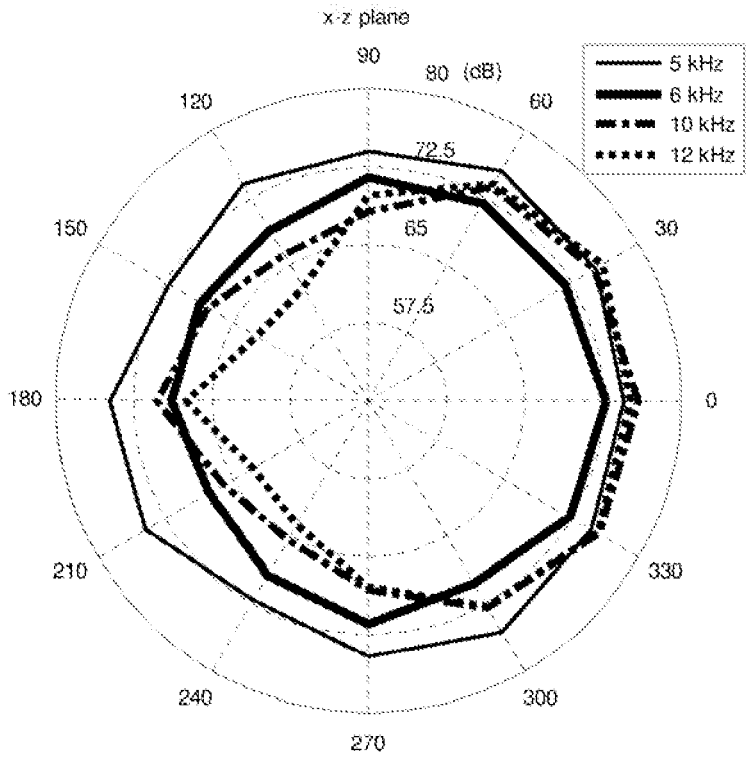
Figure 5:
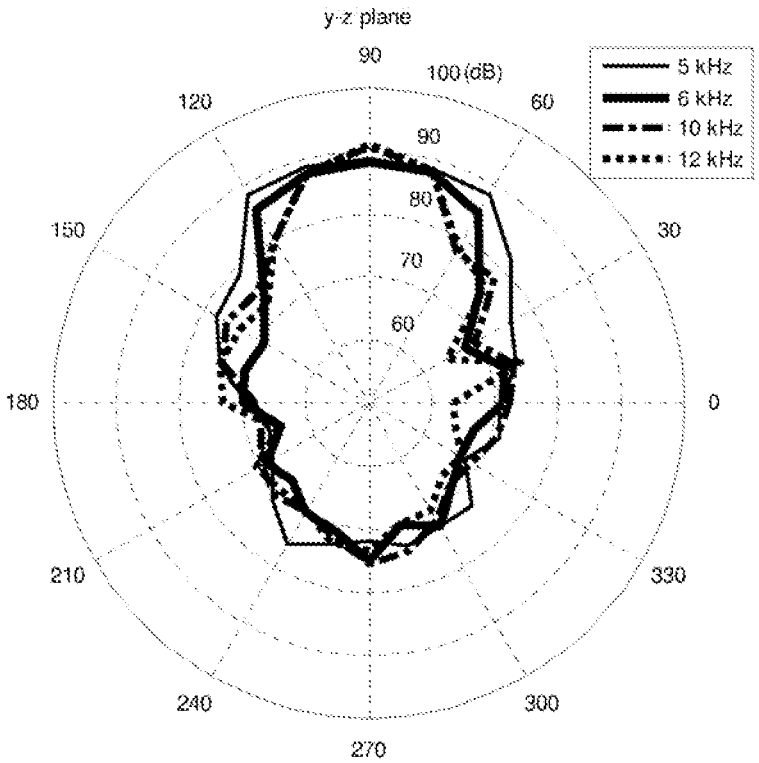

FIGS. 3 to 5 are exemplary radiation patterns of the directional acoustic component according to an embodiment. FIG. 3 illustrates the radiation pattern at an X-Y plane, FIG. 4 illustrates the radiation pattern at an X-Z plane, and FIG. 5 illustrates the radiation pattern at a Y-Z plane, wherein the X axis extends along the width direction of the pipe 101 (a positive direction of the X axis is the same as an opening direction of the slot 1013), the Y axis extends along the length of the pipe 101 (a positive direction of the Y axis is the same as an opening direction of the horn 102), and the Z axis extends along the height of the pipe 101. In some embodiments, the radiation pattern may be measured by a microphone.

Referring to FIG. 3, four polar plots at four frequencies are illustrated. The greater the decibel is, the stronger radiation there exists. From the polar plots, at each frequency, radiation is relatively strong at an angle within a range from about 65° to about 90°, that is, directivity of the directional acoustic component is embodied in these degrees. At the X-Y plane, the angle is relative to a reference line that goes through a center of the pipe 101 and perpendicular to the slot 1013. At 0°, the microphone used for measurement rightly faces the slot 1013. At about 85° to about 90°, the microphone points to a plane which the horn 102 faces, thus receiving much acoustic energy. Besides, as described above, due to the reflection of the inner surface of the pipe 101, a portion of the radiated waves are radiated into the air with the angle from about 65° to 85°. That is why the radiation at the X-Y plane is relatively strong from about 65° to 90°. As the acoustic energy is relatively strong at the angle from about 65° to 90°, the audience facing the slot 1013 may feel that sounds are coming from the angle from about 65° to 90°. Therefore, the virtual surround sound effect is improved. Besides, from the polar plots, based on the four polar plots, the higher the frequency is, the stronger the directivity of the directional acoustic component is. That is to say, the directional acoustic component provides stronger directivity at high frequency.

In FIG. 4, at each frequency, radiation is strongest at about 0°. The X-Z plane goes through the reference line that goes through the center of the pipe 101 and is perpendicular to the slot 1013, and is parallel with a plane defined by the height and the width of the pipe 101. At 0°, the microphone used for measurement rightly faces the slot 1013, while at other angles, the microphone is relatively far away from the slot 1013. That is why the radiation at the X-Z plane reaches the maximum at angle 0°. Besides, similar with FIG. 3, in FIG. 4, the higher the frequency is, the stronger the directivity of the directional acoustic component is.

In FIG. 5, at each frequency, radiation is strongest at about 90°. In the Y-Z plane, at 90°, the microphone used for measurement rightly faces the horn 102, while at other angles, the microphone is relatively far away from the horn 102. That is why the radiation at the Y-Z plane reaches the maximum at angle 90°. Besides, similar with FIG. 3, in FIG. 5, the higher the frequency is, the stronger the directivity of the directional acoustic component is.

Based on FIGS. 3 to 5, the directional acoustic component provides stronger directivity at higher frequency. And accordingly, the audience may obtain better virtual surround sound effect.

Figure 6:
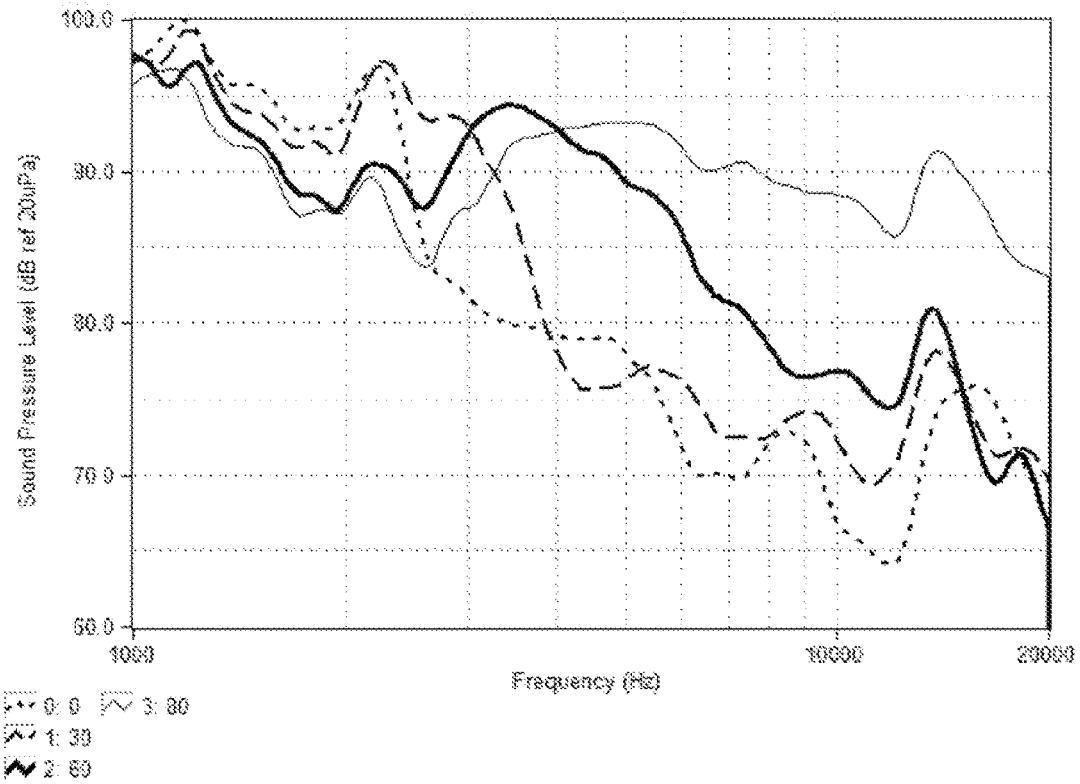
FIG. 6 is a schematic diagram illustrating frequency response of an acoustic apparatus according to an embodiment.
Figure 7:
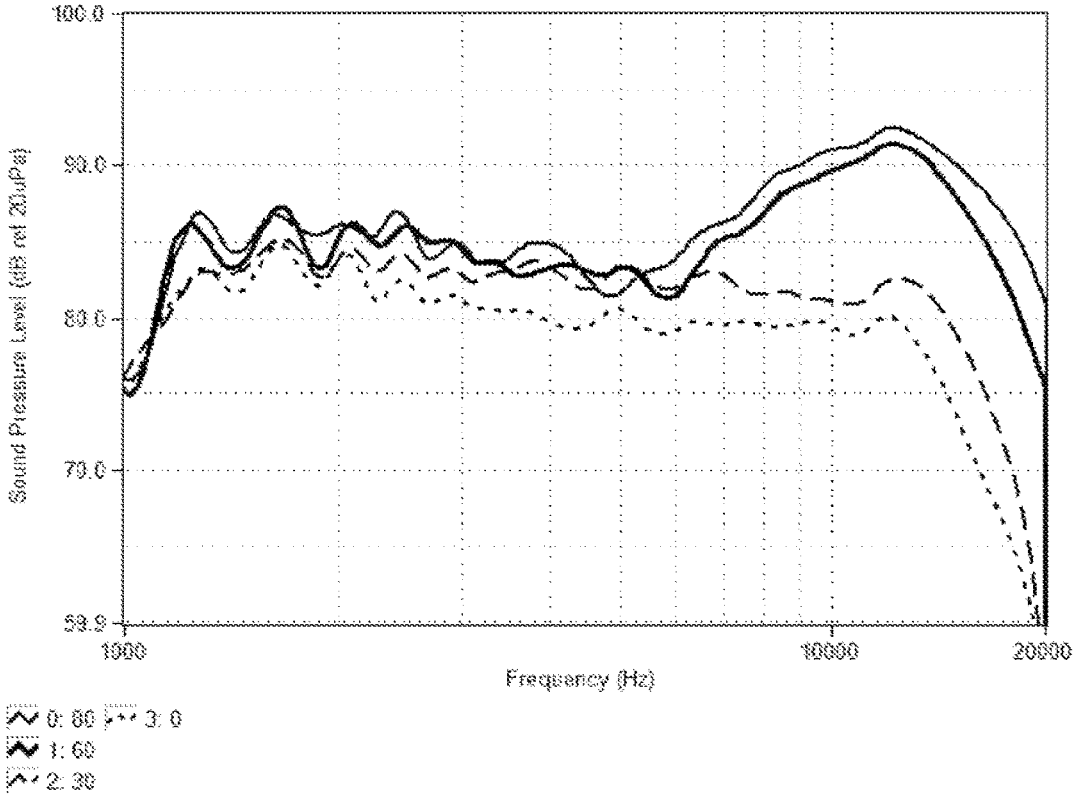
FIG. 7 is a schematic diagram illustrating frequency response of an acoustic driver according to an embodiment.

FIG. 6 is a schematic diagram illustrating frequency response of the acoustic apparatus according to an embodiment, and FIG. 7 schematically illustrates frequency response of an acoustic driver according to an embodiment.

Referring to FIGS. 6 and 7, frequency response of the acoustic apparatus at relative angles of 0°, 30°, 60° and 80° are illustrated respectively, where decibel varies by frequency. It can be seen that, decibels at high frequency in FIG. 6 are much greater than those at high frequency in FIG. 7. That is, compared with the independent acoustic driver, the acoustic apparatus which includes the directional acoustic component 10 and the acoustic driver 20 strengthen the directivity at high frequency.

From above, in operation, the combination of the pipe and the horn strengthens the directivity and improves the virtual surround sound effect at high frequency.

Figure 8:
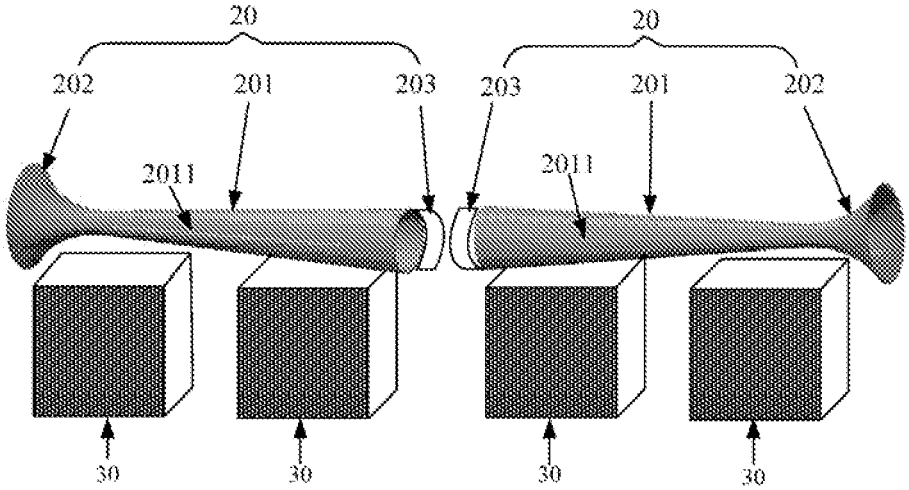
FIG. 8 is a schematic diagram illustrating an acoustic system according to an embodiment.

FIG. 8 is a schematic diagram illustrating an acoustic system according to an embodiment. Referring to FIG. 8, the acoustic system includes two acoustic apparatus 20, four speakers 30.

Each acoustic apparatus 20 includes a directional acoustic component which includes a pipe 201 and a horn 202 extending from a first end of the pipe 201, and an acoustic driver 203 acoustically coupled with a second end of the pipe 201 to radiate acoustic energy into the pipe 201. A slot 2011 is configured on the pipe 201 with an elongation direction along an elongation direction of pipe 201.

The acoustic drivers 203 of the two acoustic apparatus 20 and input terminals of the four speakers 30 may be electrically coupled with an output terminal of a power amplifier. In some embodiments, an input terminal of the power amplifier may be electrically coupled with an output terminal of a signal generator through wires. In some embodiments, the power amplifier may be coupled with the signal generator wirelessly. In some embodiments, the signal generator may be a computer, a mobile phone, etc.

Referring to FIG. 8, in operation, the four speakers 30 and the two slots 2011 face an audience, and the two horns 202 face two walls respectively.

In some embodiments, a cross-sectional area of the pipe 201 may vary along the length of the pipe 201. In some embodiments, the cross-sectional area of the pipe 201 may gradually reduce along the elongation direction of the pipe 201 from the second end of the pipe 201 to the first end of the pipe 201. In some embodiments, projections of centers of at least two cross sections of the pipe 201 to an end surface are located in different positions, wherein the end surface is the cross section of the pipe 201 at the second end of the pipe 201. In some embodiments, the cross sections of the pipe 201 may be circles, and projections of the circles to the end surface may not be concentric.

In some embodiments, width of the slot 2011 may be not greater than 2 millimeters. In some embodiments, the length of the pipe 201, a cross-sectional area of the pipe 201 at the first end and a cross-sectional area of the pipe 201 at the second end are configured, on the condition that at least a portion of waves radiated into the pipe 201 are reflected by an inner surface of the pipe 201 to form reflected waves penetrating the slot 2011, wherein the reflected waves forms an angle within a range from about 155° to about 175° relative to the slot 2011.

With the above structure, the acoustic apparatus 20 may provide strengthened directivity and better virtual surround sound effect at high frequency.

In some embodiments, the speakers 30 may be common loudspeakers which have good virtual surround sound effect at mid frequency and low frequency.

It should be noted that, the number of the speakers 30 is not limited to four and depends upon practical requirements. The arrangement of the acoustic apparatus 20 and the speakers 30 is not limited to the way illustrated in FIG. 8.

In operation, due to the combination of the acoustic apparatus 20 and the speakers 30, the acoustic system may provide good virtual surround sound effect at low, mid and high frequencies.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. An acoustic component, comprising:

a pipe having a slot configured on the pipe, the slot having an elongation direction along an elongation direction of the pipe;

a cross-sectional area of the pipe gradually reduces along the elongation direction of the pipe from a second end of the pipe to the first end, an end surface is the cross section of the pipe at the second end of the pipe and projections of at least two cross sections of the pipe to the end surface are located in different positions; and a horn extending from a first end of the pipe.

2. The acoustic component according to claim 1, wherein the cross sections are circles and projections of centers of at least two cross sections of the pipe to an end surface are not concentric.

3. The acoustic component according to claim 1, wherein a length of the pipe, a cross-sectional area of the pipe at the first end and a cross-sectional area of the pipe at the second end are configured, on the condition that at least a portion of waves radiated into the pipe are reflected by an inner surface of the pipe to form reflected waves penetrating the slot, wherein the reflected waves form an angle within a range from 155° to 175° relative to the slot.

4. The acoustic component according to claim 1, wherein width of the slot is not greater than 2 millimeters.

5. The acoustic component according to claim 1, wherein length of the slot is less than length of the pipe.

6. An acoustic apparatus, comprising:

an acoustic component, having:

a pipe having a slot configured on the pipe, the slot having an elongation direction along an elongation direction of the pipe;

a cross-sectional area of the pipe gradually reduces along the elongation direction of the pipe from a second end of the pipe to the first end, projections of at least two cross sections of the pipe to an end surface are located in different positions, the end surface is the cross section of the pipe at the second end of the pipe;

a horn extending from a first end of the pipe; and an acoustic driver acoustically coupled with a second end of the pipe to radiate acoustic energy carried in waves to a listening environment through the slot and the horn.

7. The acoustic apparatus according to claim 6, wherein the cross sections of the pipe are circles and projections of the circles to the end surface are not concentric.

8. The acoustic apparatus according to claim 6, wherein a length of the pipe, a cross-sectional area of the pipe at the first end and a cross-sectional area of the pipe at the second end are configured, on the condition that at least a portion of waves radiated into the pipe are reflected by an inner surface of the pipe to form reflected waves penetrating the slot, wherein the reflected waves form an angle within a range from 155° to 175° relative to the slot.

9. The acoustic apparatus according to claim 6, wherein width of the slot is not greater than 2 millimeters.

10. The acoustic apparatus according to claim 6, wherein length of the slot is less than length of the pipe.

11. An acoustic system, comprising:

an acoustic component having:

a pipe having a slot configured on the pipe, the slot having an elongation direction along an elongation direction of the pipe;

a cross-sectional area of the pipe gradually reduces along the elongation direction of the pipe from the second end of the pipe to the first end of the pipe, projections of centers of at least two cross sections of the pipe to an end surface are located in different positions, wherein the end surface is the cross section of the pipe at the second end of the pipe; and a horn extending from a first end of the pipe;

an acoustic driver acoustically coupled with a second end of the pipe to radiate acoustic energy carried in waves to a listening environment through the slot and the horn; and at least one speaker.

12. The acoustic system according to claim 11, wherein the cross sections of the pipe are circles and projections of centers of at least two cross sections of the pipe to the end surface are not concentric.

13. The acoustic system according to claim 11, wherein a length of the pipe, a cross-sectional area of the pipe at the first end and a cross-sectional area of the pipe at the second end are configured, on the condition that at least a portion of waves radiated into the pipe are reflected by an inner surface of the pipe to form reflected waves penetrating the slot, wherein the reflected waves form an angle within a range from 155° to 175° relative to the slot.

14. The acoustic system according to claim 11, wherein a width of the slot is not greater than 2 millimeters.

15. The acoustic system according to claim 11, wherein a length of the slot is less than length of the pipe.

* * * * *